US008070538B2

(12) United States Patent
Kamio

(10) Patent No.: US 8,070,538 B2
(45) Date of Patent: Dec. 6, 2011

(54) JET PUMP OF PERSONAL WATERCRAFT

(75) Inventor: Kunihiko Kamio, Akashi (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 82 days.

(21) Appl. No.: 11/821,584

(22) Filed: Jun. 22, 2007

(65) Prior Publication Data

US 2008/0318481 A1 Dec. 25, 2008

(51) Int. Cl.
*B63H 11/107* (2006.01)

(52) U.S. Cl. ..... 440/40

(58) Field of Classification Search ..... 440/38, 440/40, 47

See application file for complete search history.

(56) References Cited

U.S. PATENT DOCUMENTS 5,713,769 A * 2/1998 Jones ..... 440/38
7,108,569 B2 * 9/2006 Cornell ..... 440/1

FOREIGN PATENT DOCUMENTS

JP 09-125904 5/1997

* cited by examiner

*Primary Examiner* — Daniel Venne
(74) *Attorney, Agent, or Firm* — Alleman Hall McCoy Russell & Tuttle LLP

(57) ABSTRACT

A jet pump of a personal watercraft of the present invention includes a pump casing 10 provided with a fairing vane part including a plurality of fairing vanes 12, and the front portion of each of the fairing vanes 12 has two attack angles which are an attack angle α of the fairing vane and the front end attack angle β which is larger than the attack angle α. Thereby, the attack angle of the fairing vane is adapted to the water jet flow so that reduction of pump efficiency is suppressed.

2 Claims, 8 Drawing Sheets

JET PUMP OF PERSONAL WATERCRAFT

TECHNICAL FIELD

The present invention relates to a water-jet pump (hereinafter simply referred to as "jet pump") of a personal watercraft, and particularly to a jet pump suitable for a personal watercraft which is equipped with a high-power engine.

BACKGROUND ART

In recent years, so-called jet-propulsion personal watercraft (PWC) have been widely used in leisure, sport, rescue activities, and the like. The personal watercraft is generally configured to suck water under a body from a water intake provided on a hull bottom surface and to pressurize and accelerate the water by an impeller of a jet pump to eject the water rearward of the body. As the resulting reaction, the personal watercraft is propelled forward.

As used in the specification and claims, directions are referenced from the perspective of a rider riding in the personal watercraft, and therefore, travel direction of the personal watercraft is "forward."

FIG. 6A is a cross-sectional view of an outer peripheral portion of fairing vanes of a conventional pump casing. FIG. 6B is a view showing a detailed structure of an attack angle at a front end portion of the fairing vane shown in FIG. 6A. In these Figures, the left side is forward. As shown in FIG. 6A, an impeller placement part 63 in which an impeller is placed is provided at a front portion of a tubular pump casing 60, and a fairing vane part 64 in which a plurality of fairing vanes 62 are arranged to guide a rotational jet flow pressurized, accelerated and ejected by the impeller and to convert a rotational component thereof into a propulsion force, is provided behind the impeller placement part 63. Each fairing vane 62 provided in the fairing vane part 64 has a structure in which a front end portion thereof is directed toward an entry angle direction of a rotational jet flow generated by the impeller to form an attack angle $\alpha$ and an axis of a rear portion thereof conforms to an axis of the pump casing 60. As shown in FIG. 6B, the attack angle $\alpha$ at the front end of the fairing vane is an angle with respect to the axis of the pump casing 60.

In recent years, large-sized personal watercraft have been developed. Engines mounted in relatively large-sized personal watercraft are designed to output much higher power than the conventional engines. As one example of such high-power engines, an engine equipped with a supercharger which is a supercharging machine for pressurizing air taken into the engine has been manufactured. For the purpose of increasing pump efficiency, the jet pump of the personal watercraft equipped with the high-power engine is expected to reduce pressure loss by minimizing a distance between the impeller disposed in the front portion of the pump casing and the fairing vanes arranged in the rear portion of the pump casing. In addition, the jet pump is expected to increase efficiency by increasing the fairing vanes in number.

However, as the distance between the impeller and the fairing vanes decreases, cavitation is more likely to be generated particularly at a region near outer peripheral portions of the fairing vanes, causing decreasing pump efficiency. In many cases, such cavitation is generated by the fact that the impeller is driven to rotate at a high speed by the high-power engine so as to increase a speed of the water jet flow.

To avoid generation of the cavitation, increasing the attack angle $\alpha$ of the fairing vanes 62 shown in FIG. 6B is effective. However, in the case of the jet pump of the personal watercraft, it is difficult to increase the attack angle $\alpha$ of the fairing vanes 62, considering the fact that the pump casing is mounted in a narrow space and has a small diameter, and the pump casing 60 and the fairing vanes 62 are integrally cast. To be specific, in a case where the fairing vanes 62 are integrally formed inside the pump casing 60 by casting, it is necessary to design the shape of the fairing vanes 62 so that they can be taken out from a casting mold. So, increasing the attack angle of the fairing vanes will make it difficult to take out the fairing vanes from the casting mold.

Furthermore, it is difficult to increase the fairing vanes 62 in number, because a flow passage formed in the pump casing 60 having a small diameter as described above is narrowed, reducing pump efficiency.

As a prior art fairing vane of this type, a fairing vane of a turbine which is cut in straight-line shape from an intermediate point of its back-surface side exit portion to its tip end to inhibit separation of a jet flow is disclosed (see Japanese Laid-Open Patent Application Publication No. Hei. 9-125904). However, this prior art is intended to inhibit separation of the jet flow at the exit portion of the fairing vane, and is incapable of suppressing generation of the cavitation at the front portion of the fairing vane in the jet pump of the personal watercraft.

SUMMARY OF THE INVENTION

An object of the present invention is to provide a jet pump of a personal watercraft which is capable of suppressing generation of cavitation at a front portion of a fairing vane.

The present invention has been developed under these circumstances, and a jet pump of a personal watercraft comprises a pump casing provided with a fairing vane part including a plurality of fairing vanes; wherein a front portion of each of the fairing vanes has two attack angles which are an attack angle of the fairing vane and a front end attack angle which is larger than the attack angle.

Accordingly, the attack angle at the front portion of the fairing vane can be made large with a relatively simple construction. Since the attack angle of the fairing vane with respect to an entry angle of a rotational jet flow ejected from the impeller can be set to a desired angle, generation of cavitation is suppressed and a rotational component of the rotational jet flow is guided. As a result, stable pump efficiency can be maintained.

The two attack angles may be formed such that the two attack angles gradually change from the front end attack angle to the attack angle.

This makes it possible to smoothly guide rearward the water jet flowing from the front end attack angle which is larger to the attack angle at the front portion of the fairing vane.

The front end attack angle may be formed on an outer peripheral portion of each of the fairing vanes.

This makes it possible to efficiently suppress generation of cavitation at the outer peripheral portion of the fairing vane where the water jet flows at a high speed and as a result, cavitation tends to be generated.

The front end attack angle may be formed by providing a cut portion whose dimension is substantially half of a radial dimension of each of the fairing vanes.

This makes it possible to stably suppress generation of cavitation at the outer peripheral portion of the fairing vane where the water jet flows at a high speed and as a result, cavitation tends to be generated, even when the fairing vane is disposed closer to the impeller to make the distance between them short.

The cut portion may be formed by cutting a predetermined amount of a front end portion of each of the fairing vanes in a rearward direction of the pump casing.

This makes it possible to efficiently suppress generation of cavitation by forming the cut portion of the predetermined amount at the outer peripheral portion of the fairing vane to adjust a distance between the fairing vane and the impeller even in the jet pump in which the distance between the fairing vanes and the impeller is made short.

The cut portion may be formed by a machining process.

The machining process makes it easy to change the front end attack angle as desired and to adapt the front end attack angle of the fairing vane to be suitable for the impeller.

A personal watercraft of the present invention comprises the above described jet pump.

In this construction, in the personal watercraft equipped with an engine, generation of cavitation at the jet pump can be suppressed, so that stable pump performance is maintained and therefore preferable traveling performance is maintained.

The above and further objects, features and advantages of the invention will more fully be apparent from the following detailed description with accompanying drawings.

DETAILED DESCRIPTION OF THE PREFERRED EMBODIMENTS

Figure 1:
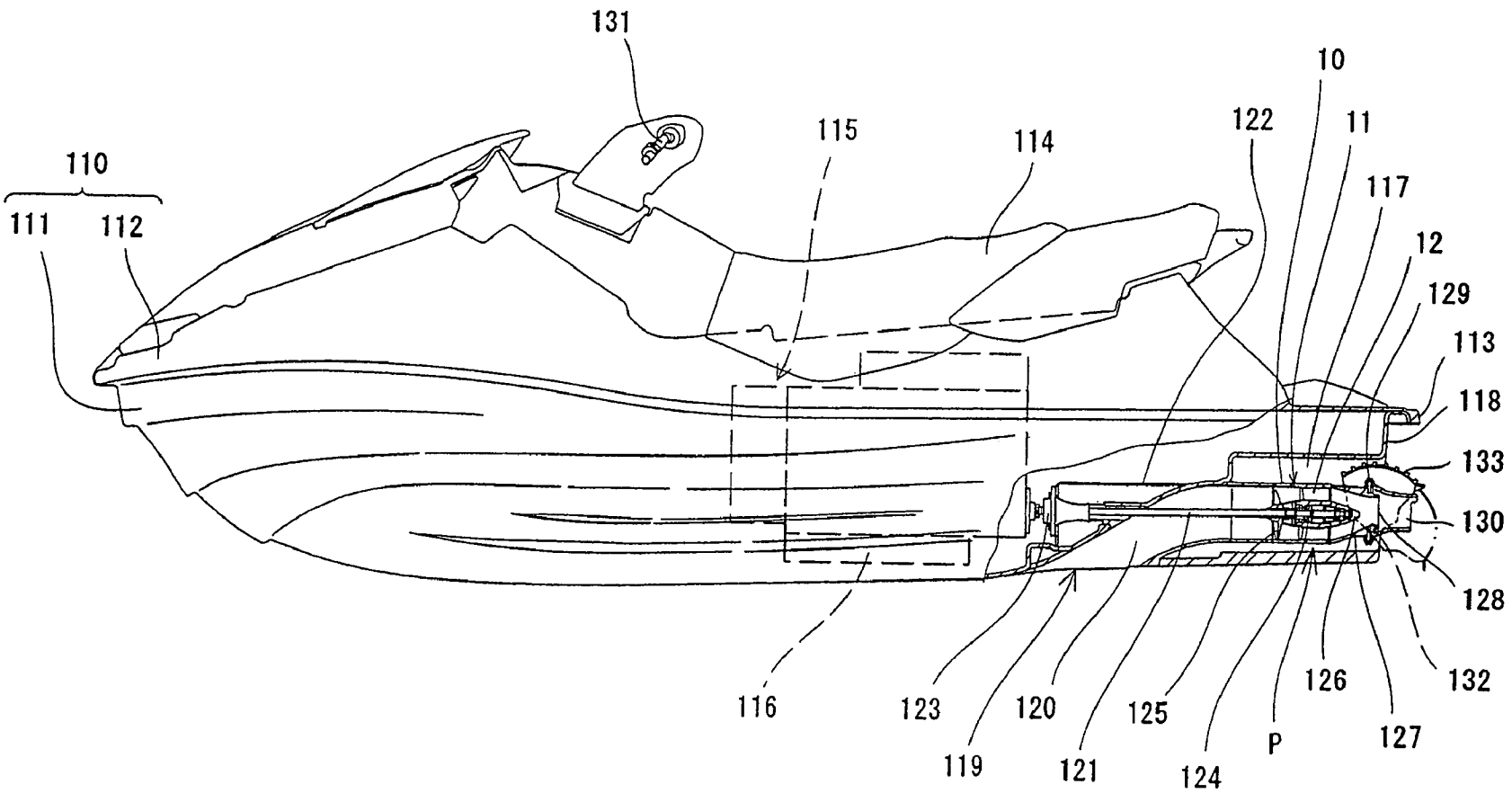
FIG. 1 is a left side view of a personal watercraft equipped with a jet pump according to an embodiment of the present invention, a part of which is illustrated in cross-section.

Hereinafter, a jet pump of a personal watercraft according to an embodiment of the present invention will be described with reference to the drawings. FIG. 1 is a left side view of a personal watercraft equipped with a jet pump according to an embodiment of the present invention, a part of which is illustrated in cross-section.

As shown in FIG. 1, a body 110 of the personal watercraft according to the embodiment of the present invention includes a hull 111 and a deck 112 for covering the hull 111 from above. The hull 111 and the deck 112 are jointed to each other over an entire periphery thereof.

A straddle-type seat 114 is mounted in a rear portion of the deck 112 to extend rearward from a substantial center. An engine room 115 is a space defined by the hull 111 and the deck 112 below the seat 114. An engine 116 is mounted in the engine room 115.

A pump room 117 is formed at a rear portion of the hull 111. A water-jet pump P is accommodated in the pump room 117. The pump room 117 is formed integrally with the hull 111 by recessing inward a transom 118 and a rear end portion of a center section in a width direction of a hull bottom in a rectangular shape. The hull 111 is provided with a water intake 119 at a center region in the width direction of a bottom surface. A water passage 120 extends from the water intake 119 toward a front surface of the pump room 117 in a shape of a smooth curved line. The jet pump P is provided with a pump casing 10 formed in a cylindrical shape. A front end of the pump casing 10 is coupled to the water passage 120. The pump casing 10 is fixedly mounted to the hull 111.

A bearing room 122 is formed between the water passage 120 and the engine 116 and is configured to rotatably support a drive shaft 121 extending rearward from the engine 116. A bearing 123 is mounted on a front surface portion of the bearing room 122 and has a sealed structure. The drive shaft 121 extending rearward from the engine 116 is rotatably supported at a front end portion thereof by the bearing 123. A rear portion of the drive shaft 121 extends inside the water passage 120 and is rotatably supported by a bearing 124 mounted in a bearing part 11 provided at a center section of the pump casing 10. The drive shaft 121 is attached with an impeller 125 at a front portion of the bearing part 11 such that the impeller 125 is rotatable integrally with the drive shaft 121. The impeller 125 is disposed inside of a front portion of the pump casing 10 and its outer peripheral portion is covered with the pump casing 10.

A plurality of fairing vanes 12 are arranged at a rear portion of the pump casing 10 to fair a rotational water flow ejected from the impeller 125 and guide it rearward of the body. The fairing vanes 12 extend radially from the bearing part 11 mounted at the center section of the pump casing 10. The fairing vanes 12 and the bearing part 11 are cast integrally with the pump casing 10. A rear portion of the bearing part 11 which is shown is closed in a sealed state with a bearing cover 126.

A pump nozzle 127 is provided at a rear portion of the pump casing 10 and has a flow cross-sectional area that is reduced rearward. The water jet is ejected from an outlet port 128 formed at a rear end portion of the pump nozzle 127, and as the resulting reaction, a propulsion force is obtained.

A steering nozzle 130 is disposed behind the pump nozzle 127 and is configured to be pivotable to the right and to the left around a pivot shaft 129 extending vertically. A bar-type steering handle 131 is attached to an upper portion of the deck 112. The steering handle 131 and the steering nozzle 130 operate in association with each other. The steering handle 131 is steered to cause the steering nozzle 130 to be pivoted to the right or to the left so that direction of the water jet flow is changed. Thus, travel direction of the watercraft is changed.

A bowl-shaped reverse deflector 133 is disposed at a rear side of an upper portion of the steering nozzle 130. The reverse deflector 133 is pivoted downward around a pivot shaft 132 horizontally provided.

When the impeller 125 of the water jet-pump P is rotated, the water is sucked from the water intake 119 provided on the bottom surface of the hull 111 into the jet pump P via the water passage 120. The impeller 125 pressurizes and accelerates the water, and ejects it from the outlet port 128 of the pump nozzle 127. As the resulting reaction, a propulsion force is gained.

When the rider rotates the handle 131 to the right or to the left, the steering nozzle 130 is pivoted in an opposite direction. As a result, the watercraft can be steered in a desired direction.

The deflector 133 is pivoted to a lower position behind the steering nozzle 130. Thereby, the water ejected rearward from the steering nozzle 130 is directed forward, so that forward travel switches to rearward travel.

Figure 2:
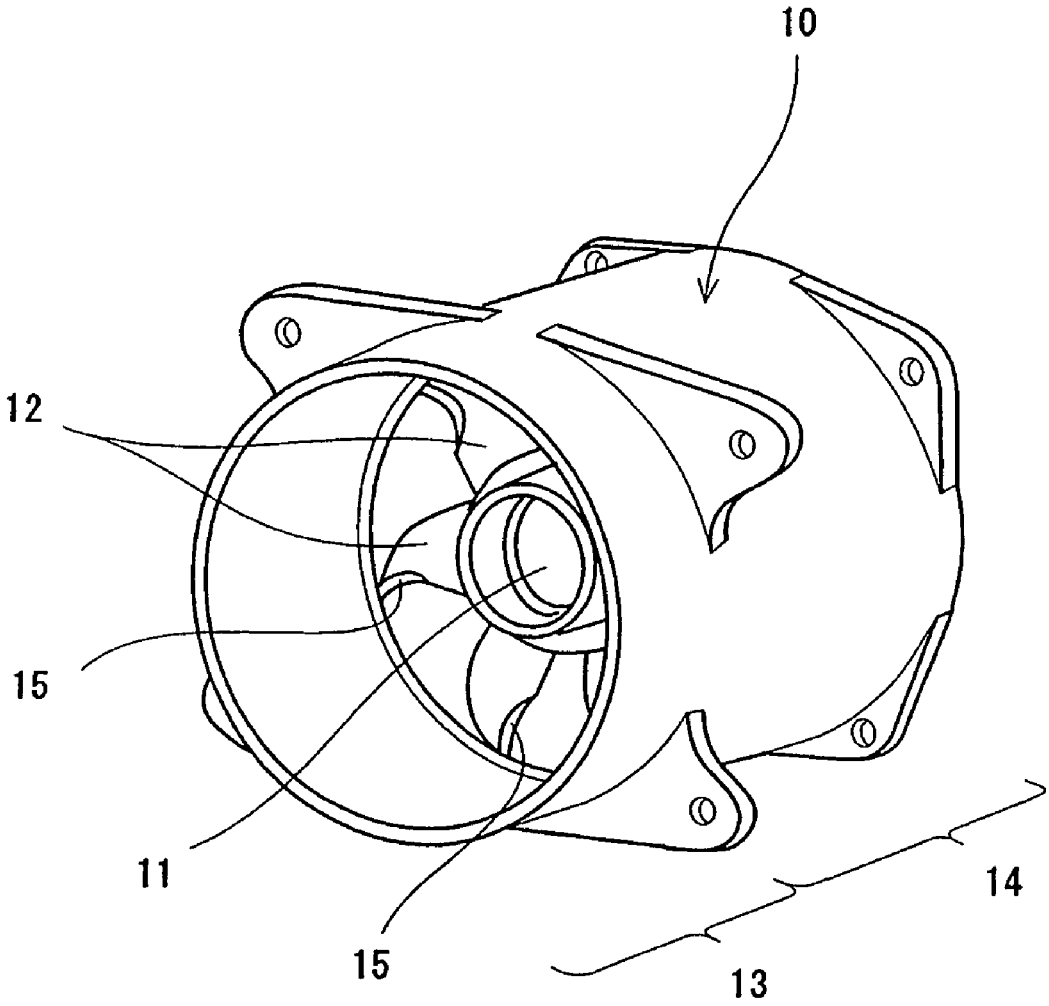
FIG. 2 is a perspective view showing a pump casing and fairing vanes of the jet pump of FIG. 1.
Figure 3:
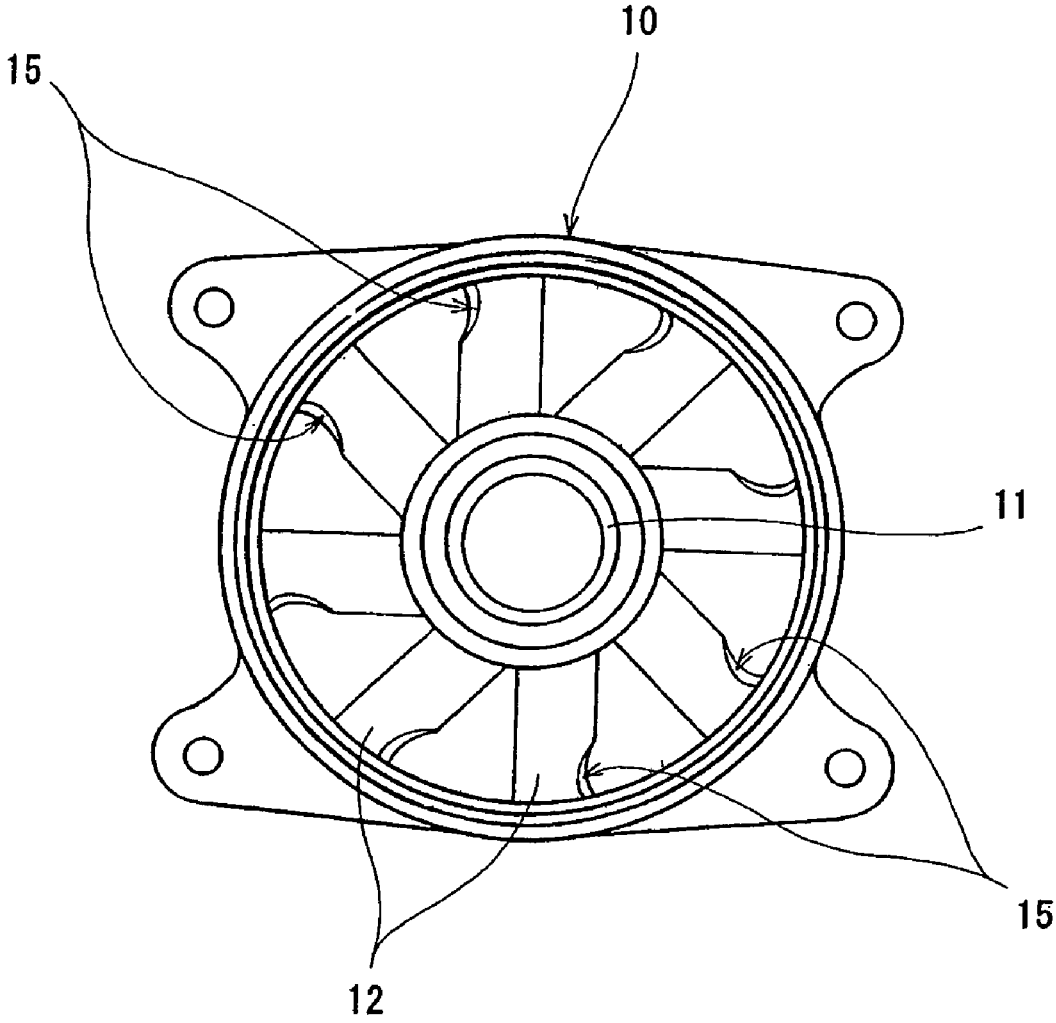
FIG. 3 is a front view showing the pump casing and the fairing vanes of the jet pump of FIG. 1.

FIG. 2 is a perspective view showing the pump casing and the fairing vanes of the jet pump of FIG. 1. FIG. 3 is a front view showing the pump casing and the fairing vanes of the jet pump of FIG. 1.

As shown in FIGS. 2 and 3, the pump casing 10 is formed in a cylindrical shape. The bearing part 11 is provided at a center region of the rear portion (right side in FIG. 2) of the pump casing 10. The plurality of fairing vanes 12 are arranged between the bearing part 11 and the pump casing 10 so as to extend radially. These fairing vanes 12 support the bearing part 11 to the pump casing 10. In the illustrated example, eight fairing vanes 12 are arranged to be equally spaced apart from each other. The impeller placement part 13 is a front portion of the pump casing 10, and the fairing vane part 14 is a portion where the fairing vanes 12 are arranged. The impeller placement part 13 and the fairing vane part 14 may be a unitary component or separate components.

In this embodiment, a cut portion 15 is formed at a front portion of each of the fairing vanes 12 by cutting a front end of the fairing vanes 12 in a rearward direction of the pump casing 10 by a predetermined amount, from its outer peripheral end thereof toward a center thereof. The cut portion 15 has a radial dimension that is subsequently half of a radial dimension of each of the fairing vanes 12.

Figure 4:
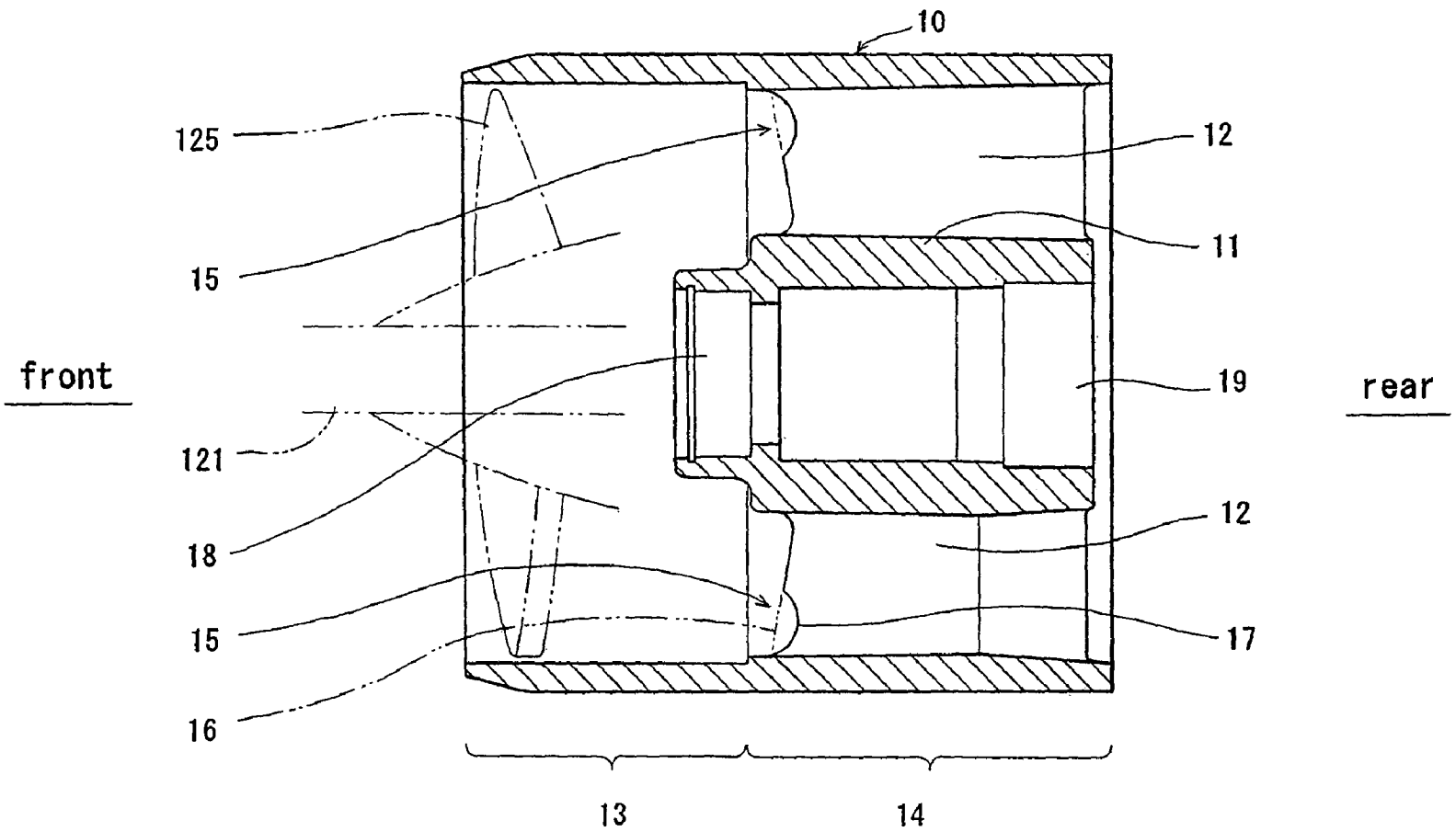
FIG. 4 is a longitudinal sectional view of the pump casing and the fairing vanes of FIG. 3.
Figure 5A:
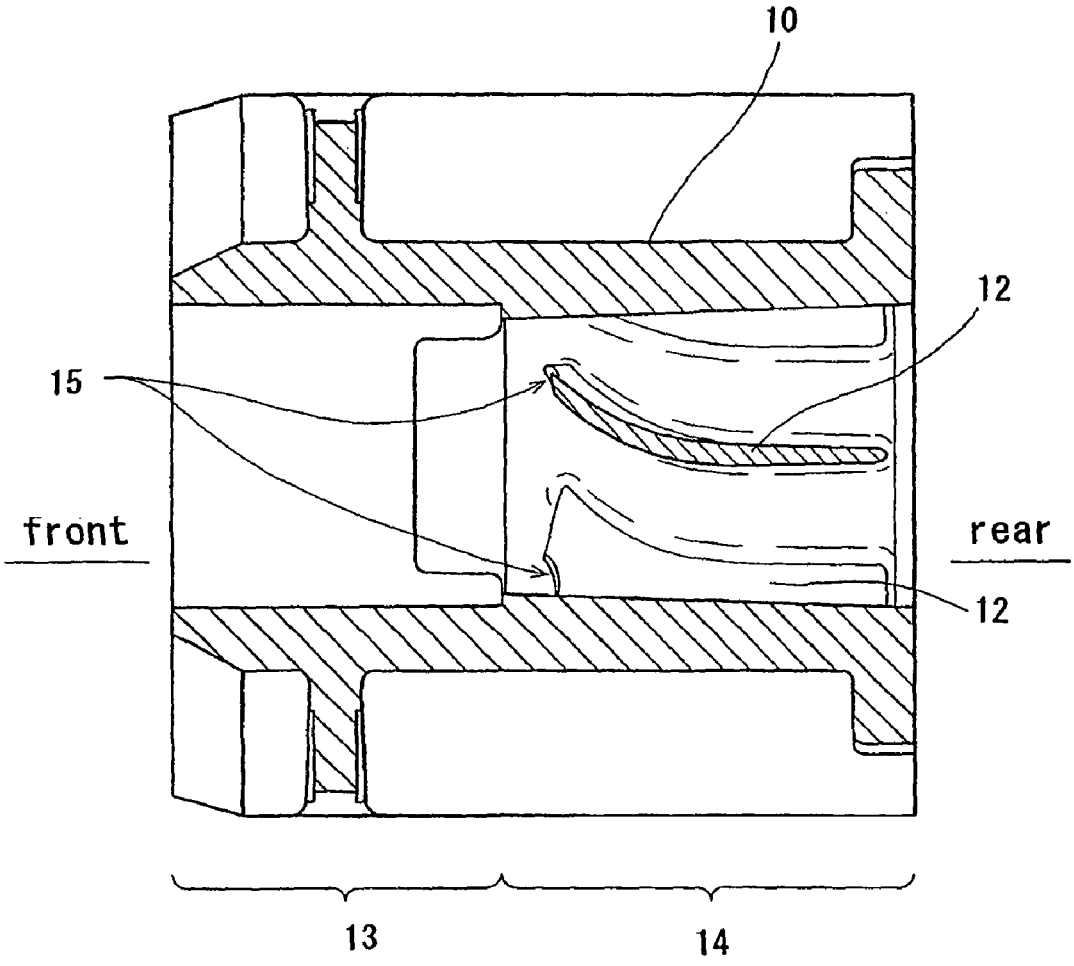
FIG. 5A is a longitudinal sectional view of the pump casing of FIG. 3 at an outer peripheral portion of the fairing vanes.
Figure 5B:
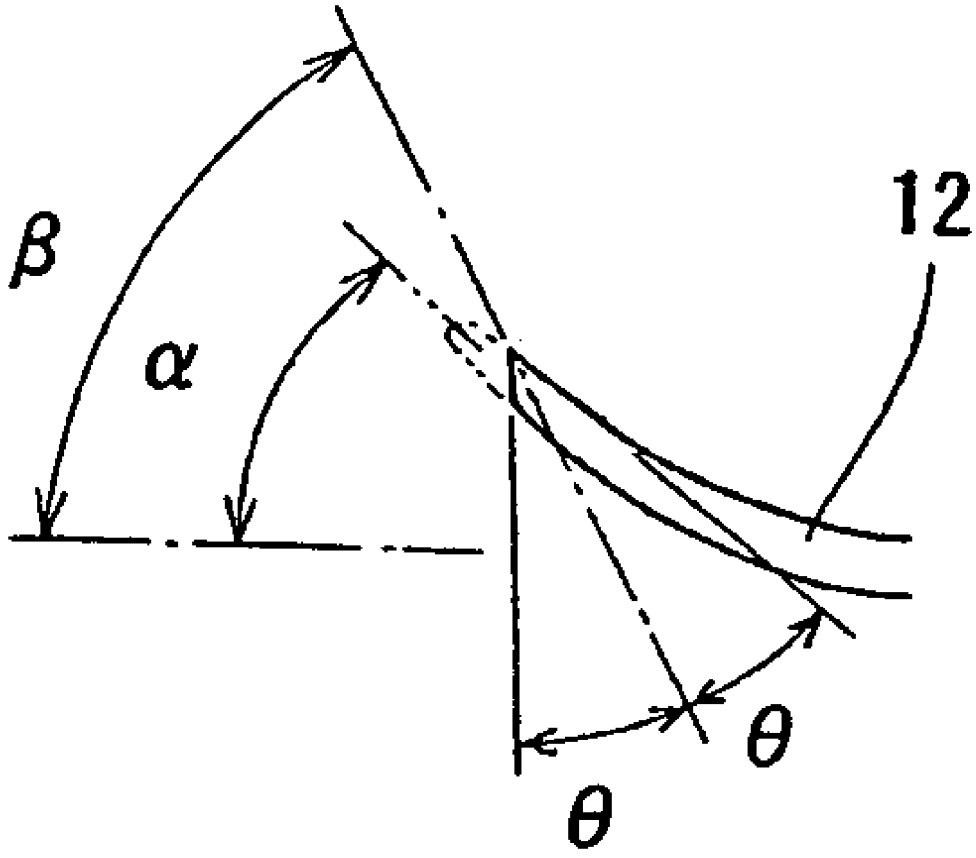
FIG. 5B is a view showing a detailed structure of an attack angle at a front end portion of the fairing vane of FIG. 5A.
Figure 6A:
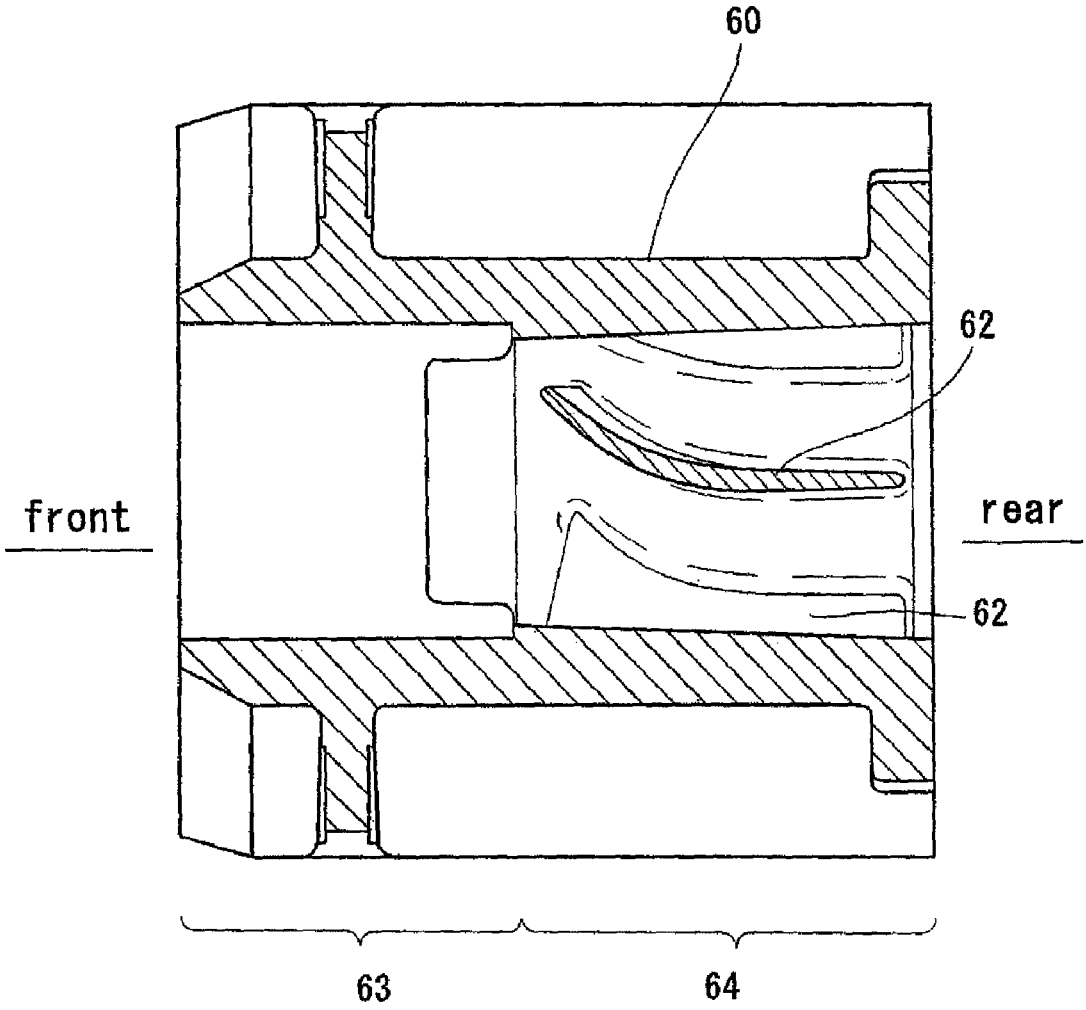
Fig. 6 A PRIOR ART
FIG. 6A is a cross-sectional view of a conventional pump casing at an outer peripheral portion of the fairing vanes.
Figure 6B:
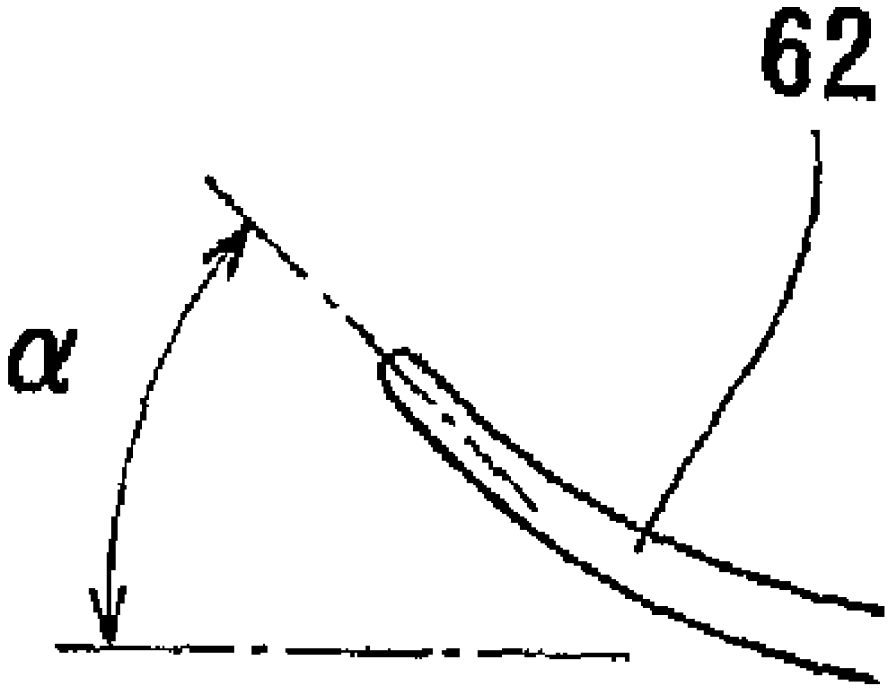
Fig. 6B PRIOR ART
FIG. 6B is a view showing a detailed structure of an attack angle at a front end portion of the fairing vane of FIG. 6A.

FIG. 4 is a longitudinal sectional view of the pump casing and the fairing vanes of FIG. 3. FIG. 5A is a longitudinal sectional view of the pump casing of FIG. 3 at the outer peripheral portion of the fairing vanes. FIG. 5B is a view showing a detailed structure of an attack angle at a front end portion of the fairing vane of FIG. 5A. In these Figures, the left side is forward.

As shown in FIG. 4, the front end 16 of each of the fairing vanes 12 which is not formed with the cut portion 15 is, as indicated by a two-dotted line, inclined rearward gradually from the outer peripheral end thereof coupled to the pump casing 10 toward an inner peripheral end coupled to the bearing part 11. The cut portion 15 is formed by cutting in a rearward direction the front end portion of each of the fairing vanes 12 from its outer peripheral end to substantially half in a radial direction. In this embodiment, the cut portion 15 is formed in a substantially semicircular shape, and a rearmost point (deepest point) 17 of the cut portion 15 substantially conforms to the inner peripheral end of each of the fairing vanes 12 in an axial direction of the fairing vanes 12.

The bearing part 11 is provided with an opening 18 and an opening 19 at a front end and a rear end thereof, respectively, and has a hollow portion therein to receive the bearing 124 (FIG. 1). The drive shaft 121 (FIG. 1) is inserted from the opening 18 at the front end of the bearing part 11. The bearing 124 (FIG. 1) mounted inside through the opening 19 at the rear end supports a rear end portion of the drive shaft 121 (FIG. 1). In FIG. 4, a part of the drive shaft 121 and the impeller 125 are indicated by two-dotted lines.

The cut portion 15 shown in FIG. 5A is formed by cutting a predetermined amount, of the front end portion of each of the fairing vanes 12 by, for example, a machining process. The fairing vanes 12, the pump casing 10, and the bearing part 11 are integrally cast and then the front end portions of the fairing vanes 12 are cut by a cutting tool from forward of the pump casing 10.

As shown in FIG. 5B, the cut portion 15 is formed by cutting the front end portion of the fairing vane 12 with a predetermined angle such that a front end attack angle β of the cut portion 15 has a larger angle than a normal attack angle α. In the illustrated embodiment, the cut portion 15 is formed by cutting a forward surface of the fairing vane 12 with a predetermined angle which is substantially perpendicular to the center axis of the pump casing 10 to increase the front end attack angle β which is formed by an intermediate line of an angle formed between the forward surface of the cut portion 15 and a rearward surface of the fairing vane 12. Thereby, the two attack angles α and β, the normal attack angle α and the front end attack angle β which is larger than the normal attack angle α are provided at the front portion of the fairing vane 12.

Since the cut portion 15 is formed by the machining process as described above, the fairing vanes 12 can be taken out from the mold as in a conventional method, and therefore, the front end attack angle β of the fairing vanes 12 can be made larger without changing facility or equipment. Alternatively, the cut portion 15 may be formed by a casting process, instead of the machining process.

In this embodiment, the cut portion 15 formed by cutting the forward surface in a flat shape forms the front end attack angle β. Therefore, an angle is formed between the cut portion 15 and a forward surface of the fairing vane 12 (lower part on the left side of FIG. 5B). By connecting each of the cut portions 15 to the forward surface of the associated fairing vane 12 to form a smooth curved surface, the two attack angles formed at the front end portion of the fairing vane 12 desirably change gradually from the front end attack angle β to the attack angle α.

Furthermore, in this embodiment, the cut portion 15 is provided on the outer peripheral portion of the fairing vane 12 which the water jet ejected at a highest speed from the impeller 125 contacts. Thus, the front end attack angle β of the fairing vane 12 is made large and a distance between the fairing vane 12 and the impeller 125 is made large at a region of the fairing vane 12 which the high-speed water jet contacts. This makes it possible to suppress generation of the cavitation at the region of the fairing vane 12 and reduction of pump efficiency, even when the high-power engine drives the impeller 125 to rotate it at a high speed and thereby the speed of the water jet increases.

Therefore, the distance between the impeller 125 and the fairing vane 12 is not decreased and the front end attack angle β can be made large at the outer peripheral portion of the fairing vane 12, even when the distance between the impeller 125 and the fairing vane 12 is made shorter. Thereby, generation of the cavitation is suppressed, and as a result, stable pump performance can be maintained.

The front end attack angle β of the fairing vane 12 may be determined according to the entry angle of the rotational water flow flowing from the impeller 125 to the fairing vane 12, and depending on the output of the engine 116 or the number of blades and blade angle of the impeller 125, the number of fairing vanes 12, etc. In the case where the attack angle of the faring vane 12 is manufactured by casting, the attack angle cannot easily change its specification. However, the front end attack angle β formed by machining and the like can be easily changed even when specification of the impeller 125 is changed.

Whereas in this embodiment, the cut portion 15 extends from the outer peripheral portion toward the center in the fairing vane 12 where the speed of the water jet flow is high so that the front end attack angle β is formed at the outer peripheral portion of the front end portion of the fairing vane 12, the position of the cut portion 15 is not intended to be limited to the above embodiment. Alternatively, the front end attack angle β may be formed over the entire length of the front end portion of the fairing vane 12. Thus, the position of the front end attack angle β is not intended to be limited to the above embodiment.

Whereas in this embodiment, the cut portion 15 is formed by a part of a region of the semicircular shape by cutting the predetermined amount of the fairing vane 12 in a rearward direction of the pump casing 10, the shape of the cut portion 15 and the cut amount of the cut portion 15 are not intended to be limited to the above described embodiment.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A jet pump of a personal watercraft comprising:

a pump casing provided with a fairing vane part including a plurality of fairing vanes, and an impeller placement part for disposing an impeller in front of the plurality of fairing vanes, each of the plurality of fairing vanes having a front portion directed towards the impeller;

wherein the front portion of each of the fairing vanes has two attack angles with respect to an axis of the pump casing as viewed in a longitudinal sectional view, the two attack angles being a fairing vane attack angle and a front end attack angle, the front end attack angle being larger than the fairing vane attack angle, the two attack angles gradually changing at a front end of the fairing vane from the front end attack angle to the fairing vane attack angle; and wherein the front end attack angle is on an outer peripheral portion of each fairing vane and extends from a front end of each fairing vane at a predetermined angle in a rearward direction of the pump casing, away from the impeller, by a predetermined amount to a deepest point to form a cut portion having a semicircular shape and a radial dimension that is half of a radial dimension of the fairing vanes.

2. A personal watercraft including a water jet pump in which an impeller is configured to be driven by an engine to eject a water jet rearward, thereby obtaining a propulsion force for moving the watercraft forward, the personal watercraft comprising:

a jet pump including:

a pump casing provided with a fairing vane part including a plurality of fairing vanes, and an impeller placement part for disposing the impeller in front of the plurality of fairing vanes, each of the plurality of fairing vanes having a front portion directed towards the impeller;

wherein the fairing vanes are configured to fair a rotational water flow ejected from the impeller and guide the water flow rearward;

wherein the front portion of each of the fairing vanes has two attack angles with respect to an axis of the pump casing as viewed in a longitudinal sectional view, the two attack angles being a fairing vane attack angle and a front end attack angle which is larger than the fairing vane attack angle, the two attack angles gradually changing at a front end of the fairing vane from the front end attack angle to the fairing vane attack angle; and wherein the front end attack angle is on an outer peripheral portion of each fairing vane and extends from a front end of each fairing vane at a predetermined angle in a rearward direction of the pump casing, away from the impeller, by a predetermined amount to a deepest point to form a cut portion having a semicircular shape and a radial dimension that is half of a radial dimension of the fairing vanes.

* * * * *